US008967070B2

(12) United States Patent
Kalil

(10) Patent No.: US 8,967,070 B2
(45) Date of Patent: Mar. 3, 2015

(54) PIVOTAL TRIM TAB HULL

(71) Applicant: Anthony Kalil, Palm City, FL (US)

(72) Inventor: Anthony Kalil, Palm City, FL (US)

( * ) Notice: Subject to any disclaimer, the term of this patent is extended or adjusted under 35 U.S.C. 154(b) by 43 days.

(21) Appl. No.: 13/886,826

(22) Filed: May 3, 2013

(65) Prior Publication Data

US 2014/0026799 A1 Jan. 30, 2014

Related U.S. Application Data

(60) Provisional application No. 61/642,823, filed on May 4, 2012, provisional application No. 61/648,833, filed on May 18, 2012.

(51) Int. Cl.

| | |
|---|---|
| ***B63B 1/32*** | (2006.01) |
| ***B63B 17/00*** | (2006.01) |
| ***B63B 1/22*** | (2006.01) |
| ***B63B 1/28*** | (2006.01) |
| ***B63B 1/20*** | (2006.01) |
| ***B63B 35/85*** | (2006.01) |

(52) U.S. Cl.

CPC . *B63B 1/22* (2013.01); *B63B 1/285* (2013.01); *B63B 1/20* (2013.01); *B63B 35/85* (2013.01); *B63B 2001/201* (2013.01); *B63B 2001/202* (2013.01); *B63B 2035/855* (2013.01)

USPC ..... 114/288; 114/343; 114/285

(58) Field of Classification Search

CPC .... B63B 1/28; B63B 2001/281; B63B 1/283; B63B 1/285; B63B 1/26; B63B 1/30; B63B 1/20; B63B 2001/201; B63B 2001/202; B63B 2001/203; B63B 2001/204; B63B 2001/205; B63B 2001/207; B63B 2001/208; B63B 2001/209

USPC ..... 114/61.29, 61.32, 61.33, 62, 343, 362, 114/288, 289, 290, 291, 284, 285, 286

See application file for complete search history.

(56) References Cited

U.S. PATENT DOCUMENTS

| | | | | |
|---|---|---|---|---|
| 3,698,343 | A * | 10/1972 | Boome | 114/285 |
| 5,572,944 | A * | 11/1996 | Slikkers et al. | 114/343 |
| 6,425,341 | B1 * | 7/2002 | Devin | 114/288 |
| 8,201,514 | B2 * | 6/2012 | Coles | 114/288 |
| 8,578,873 | B2 * | 11/2013 | Gasper et al. | 114/284 |
| 2009/0308300 | A1 * | 12/2009 | Baker | 114/288 |
| 2010/0037810 | A1 * | 2/2010 | McLoughlin et al. | 114/274 |

FOREIGN PATENT DOCUMENTS

| | | | | |
|---|---|---|---|---|
| JP | 63312293 | A * | 12/1988 | B63B 1/10 |

* cited by examiner

*Primary Examiner* — Stephen Avila
*Assistant Examiner* — Andrew Polay
(74) *Attorney, Agent, or Firm* — Saliwanchik, Lloyd & Eisenschenk

(57) ABSTRACT

A boat hull configured to create a desired wake shape through a combination of two distinct hull types that interact with the water flow at specified moments. Controlled shaping of the wake shape is achieved through redirection of water flowing across the transom of the main hull, onto a secondary transom of a secondary "diffuser" suction hull that creates a negative pressure that sucks the aft portion of the boat hull into the water, thereby immersing the secondary transom into the water where it can effectively interact with the water and "carve" the desired wake shape desirable for wake surfing.

2 Claims, 14 Drawing Sheets

SECTION A-A

PIVOTAL TRIM TAB HULL

CROSS-REFERENCE TO RELATED APPLICATIONS

The present application claims priority to U.S. Provisional Patent Application Ser. No. 61/648,833, filed May 18, 2012 and U.S. Provisional Patent Application Ser. No. 61/642,823, filed May 4, 2012, which are hereby incorporated by reference herein in their entirety, including any figures, tables, or drawings.

FIELD OF THE INVENTION

The present invention generally relates to boat hulls, and in particular to a towboat boat hull manipulating various wakes popular in water sports activities.

BACKGROUND OF THE INVENTION

Towboats are a certain type of boat used for water sports, such as skiing, wakeboarding, or most recently, wake surfing. Towboats designed for towing skiers in water sports activities such as wakeboarding, water skiing, or wake surfing are generally designed with hull bottoms and hull forms that create distinct wake shapes, that cater specifically to the desirable characteristics. Wake surfing is a relatively new water sport, and it is vastly different than other water sports such as skiing or wakeboarding. Contrary to other water sports, wake surfers do not hold onto a tow rope that is attached to the boat. Rather, they utilize a wake board to surf a wake that is created by the towboat moving through the water. However, desirable wake characteristics for a wake surfer are vastly different than the characteristics desired by a wake boarder, or skier, since wake surfers prefer to "ride" the cresting wake close behind the boat without the use of a towrope, and traditional water skiers usually prefer a softer and flatter wake, while the wake boarder generally prefers a tall wake that act as a "ramp" to jump off of when crossing the wake behind the boat. Wake surfing is a new type of water sport that is becoming extremely popular, and the desired wake shape is rather difficult to achieve with traditional boat hulls.

Since wake surfing is relatively new, and the characteristics of the desired wake shape are very specialized, building a purpose-built boat hull useful for only this type of water sport would limit the boat's utility for other tow boating activities, such as skiing, and wakeboarding. Building a purpose-built wake surfing boat would also severely hinder the boat's performance for pleasure cruising, as the wake surfing boat's hull characteristics would negatively affect its ability to travel at moderate or high speeds. Consequently, there is a need to design a boat hull that can adequately create distinctive wake shapes for both wake surfing water sports, and traditional skiing and wakeboarding water sports.

BRIEF SUMMARY

Embodiments of the present invention are directed to boat performance and desired wake shaping through a combination of two distinct hull types that interact with the water flow at specified moments. Controlled shaping of the wake surfer wake is achieved through redirection of water flowing across the transom of the main hull, onto a secondary transom of a secondary "diffuser" suction hull, that by careful shaping, will achieve a negative pressure in which to suck the aft portion of the boat into the water, thereby immersing the secondary transom into the water where it can effectively interact with the water and "carve" the desired wake surfing wake. In keeping with the teachings of the present invention, a boat having a hull with a transom extending across the aft side of the hull may include a secondary running surface extending aft of the primary hull with a diffuser type of design that will cause suction when water flowing off of the initial transom is redirected, and adhered to the secondary suction hull. The secondary suction hull includes a transom of a specific shape that will "carve" the desired wake surfing type of wake into the water as the boat moves through the water. The secondary suction hull may be defined as a diffuser surface that begins aft of the primary hull transom extending longitudinally, and slightly above the primary hull bottom, so that the water flow will break cleanly off of the primary running surface at the primary transom, and will not interact with the secondary suction hull unless the water flow is specifically redirected. The secondary suction hull extends slightly upward toward its exit portion at the transom, so that its surface area increases and the water flow is redirected along its bottom surface, causing a measurable negative pressure at the secondary hull bottom. A pair of pivotal tabs (by this inventor—application Ser. No. 12/626,280, which is hereby incorporated by reference) are positioned at the primary transom with the axis of rotation perpendicular to the hulls centerline, wherein the forward edge of the tab is level with the primary hull bottom in its neutral position. In the neutral position, the water flow will continue aft from the primary hull surface, and under the pivotal tabs, where the flow will have no further interaction with any part of the boat, specifically the secondary suction hull, as this would prevent normal operation of the boat. The pivotal tabs are positioned so that the leading edges can rotate upward, where their trailing edges will interact with the water flow and divert the water flow down, keeping the water flow further away from the secondary suction hull when the hull speed is low, and the secondary suction hull function is not desired. The pivotal tabs are also positioned so that the leading edges rotate down, and into the water flow coming off of the primary hull at its transom, thereby directing the water flow on the top surfaces of the pivotal tabs. The water flow coming off of the tops of the pivotal tabs is redirected to act on the secondary suction hull that has drastically different performance qualities than the primary hull. The suction generated by the secondary suction hull will inherently change the running attitude of the boat, with a very deep stern down condition that will increase as more power is applied. This performance characteristic is in stark contrast to boats utilizing weight from a typical water ballast system where increased speeds cause the desired wake surfing wake shape to diminish. Additionally, the transom shape of the secondary suction hull is shaped so that it interacts with the water flow in a manner that specifically "carves" and shapes a desirable wake for wake surfing. This is also in stark contrast to typical tow boats utilizing weight from water ballast systems, as their primary hull and transom shapes are designed for high speed performance and general boat handling characteristics that have different qualities than a specific wake surfing type of hull, and their additional weight only lowers the standard transom lower into the water to change the position of the wake table's distance from the boat, with no actual method of "carving" a wake shape. This embodiment will allow the boat to utilize both a standard type of transom for most boating needs, and a specialized wake shaping secondary hull for specialized wake surfing qualities.

Those skilled in the art may employ various combinations of the secondary suction hull and method to redirect the water flow once having the benefit of the teachings of the present invention. By way of example, a single pivotal tab may be positioned at a transom of primary hull with a flat bottom, where dividing the pivotal tabs to interact with two planes of a typical V style hull is not necessary. In addition, other methods of redirecting water flow to a secondary hull with vastly different characteristics may be achieved.

The secondary suction hull may be positioned in a manner where the water flow is redirected by a rotating tab recessed into a pocket in the primary hull bottom. Alternatively, water flow from the primary hull may be redirected onto the secondary suction hull from deflectors mounted on the sides of the primary hull.

Furthermore, a secondary suction hull may be separately affixed to a conventional hull in order to achieve similar results.

As will be detailed later in this specification, the transom shape of the secondary suction hull when viewed from the rear view, will differ greatly from the primary hull transom shape, as the transom shape necessary for controlling a wake surf style wake is usually not conducive to high speed operation necessary in other types of water sports where a flatter wake is desirable. The transom shape of the primary hull will serve to create the optimal performance for normal operation, and water sports activities, such as skiing and wakeboarding.

In order to achieve desirable wake surfing wake shapes, the secondary suction hull transom profile may curve with complex shapes to resemble the profile of a wave in section view in order to create smaller wakes that crest further away from the transom of the boat so that the wakes can be ridden by more than one wake surfer at a time. This type of secondary transom may have a similar deadrise angles to the primary hull transom angles, when view in section.

Additionally, the secondary suction hull may employ an inverted deadrise angle, that would create an immense single wake, where the transom surface is higher in the center, than at its outside edges. This embodiment may create a large diffuser at the suction hull, that combined with a curved section that transitioned down at the outboard edges near the chines, would cause the wake shape to "fold over" and curl. This wake shape would be extremely desirable for single riders desiring a large crest to surf close to the boat.

DETAILED DESCRIPTION

The present invention will now be fully described with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and fully convey the scope of the invention to those skilled in the art.

Figure 1:
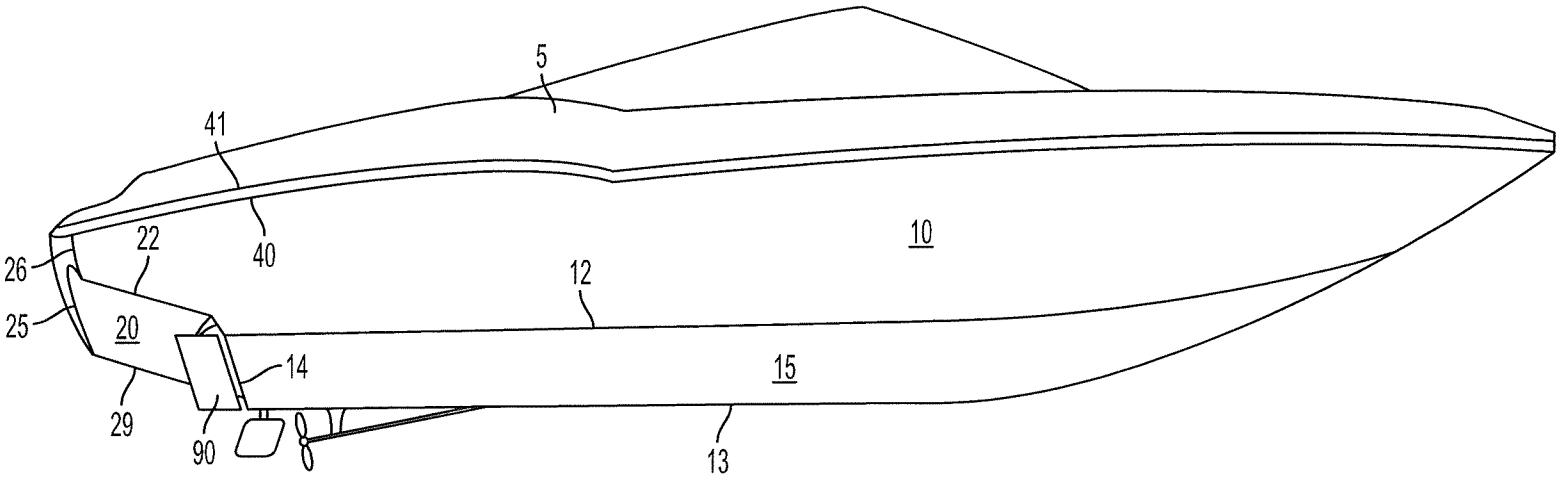
FIG. 1 is a side elevation view of a tow boat having two distinct running surfaces with the pivotal tab in place.
Figure 2:
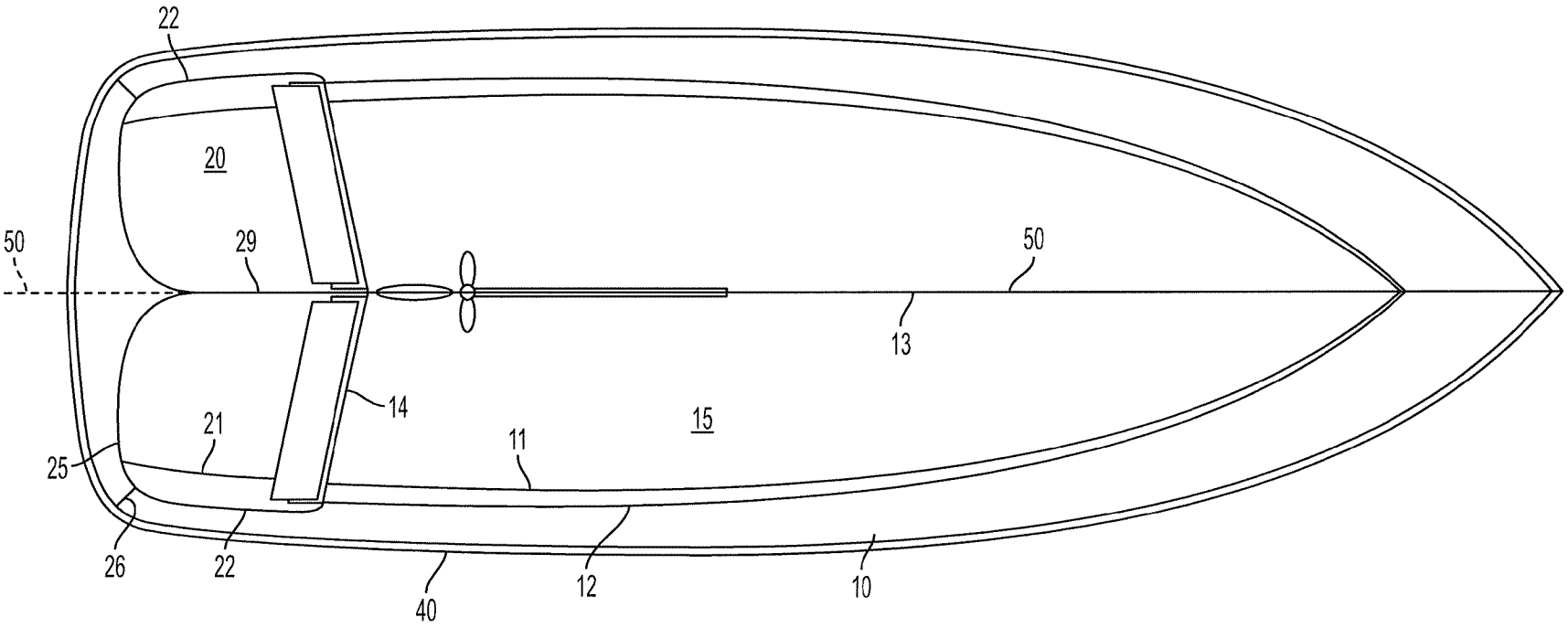
FIG. 2 is a plan view of a tow boat hull having two distinct running surfaces with the pivotal tab in place.
Figure 3:
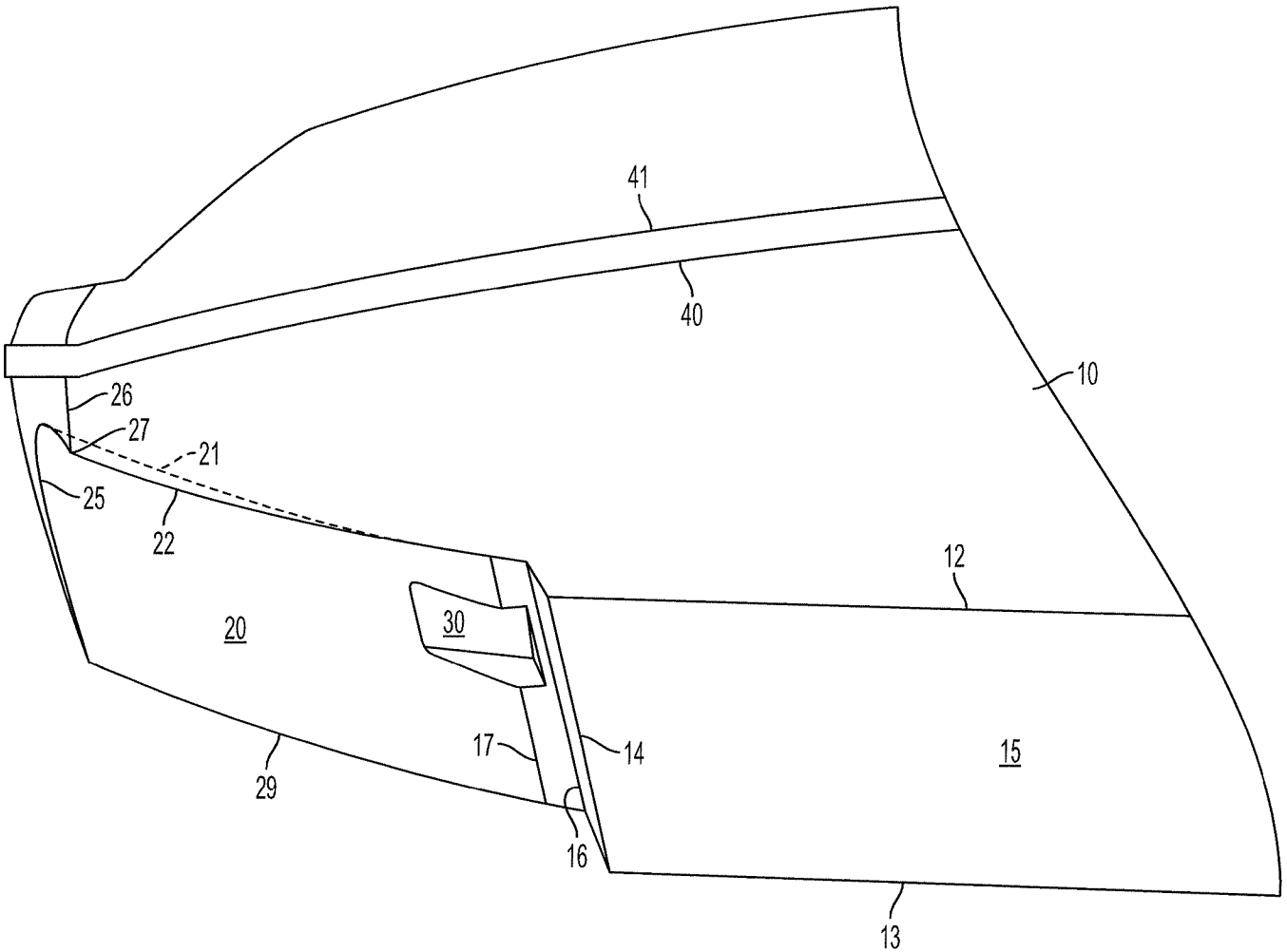
FIG. 3 is an enlarged partial stern elevation view of the tow boat of FIG. 1 shown without the pivotal tab in place.
Figure 4:
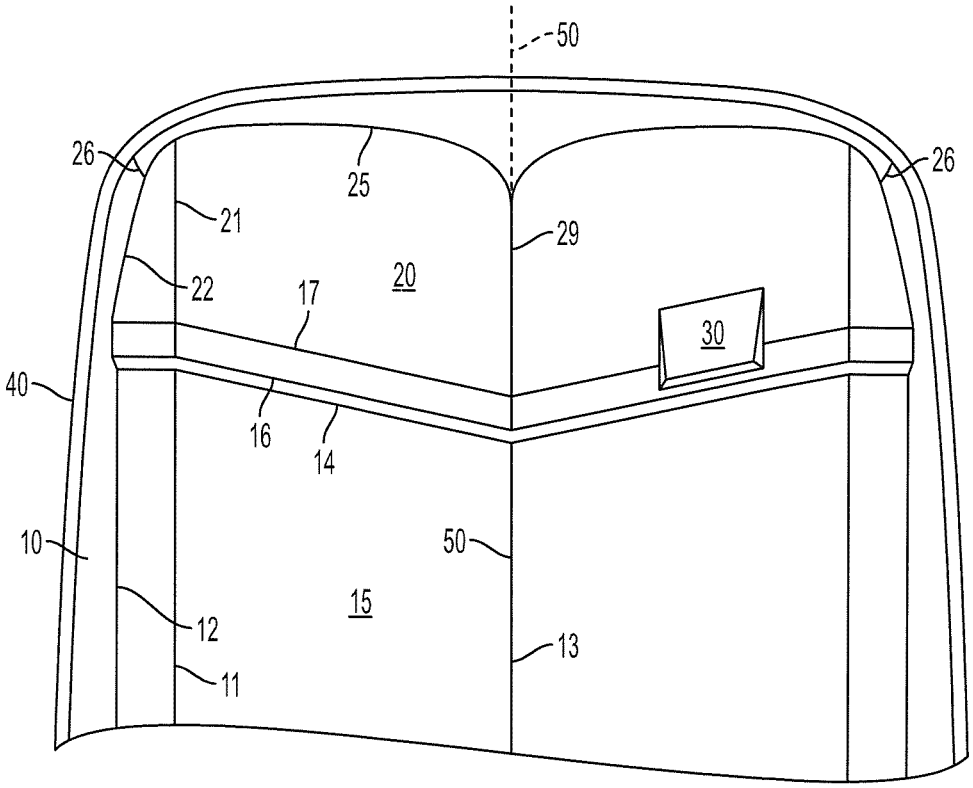
FIG. 4 is an enlarged partial bottom plan view of the tow boat stern of FIG. 1 having two distinct running surfaces shown without the pivotal tab in place.
Figure 5:
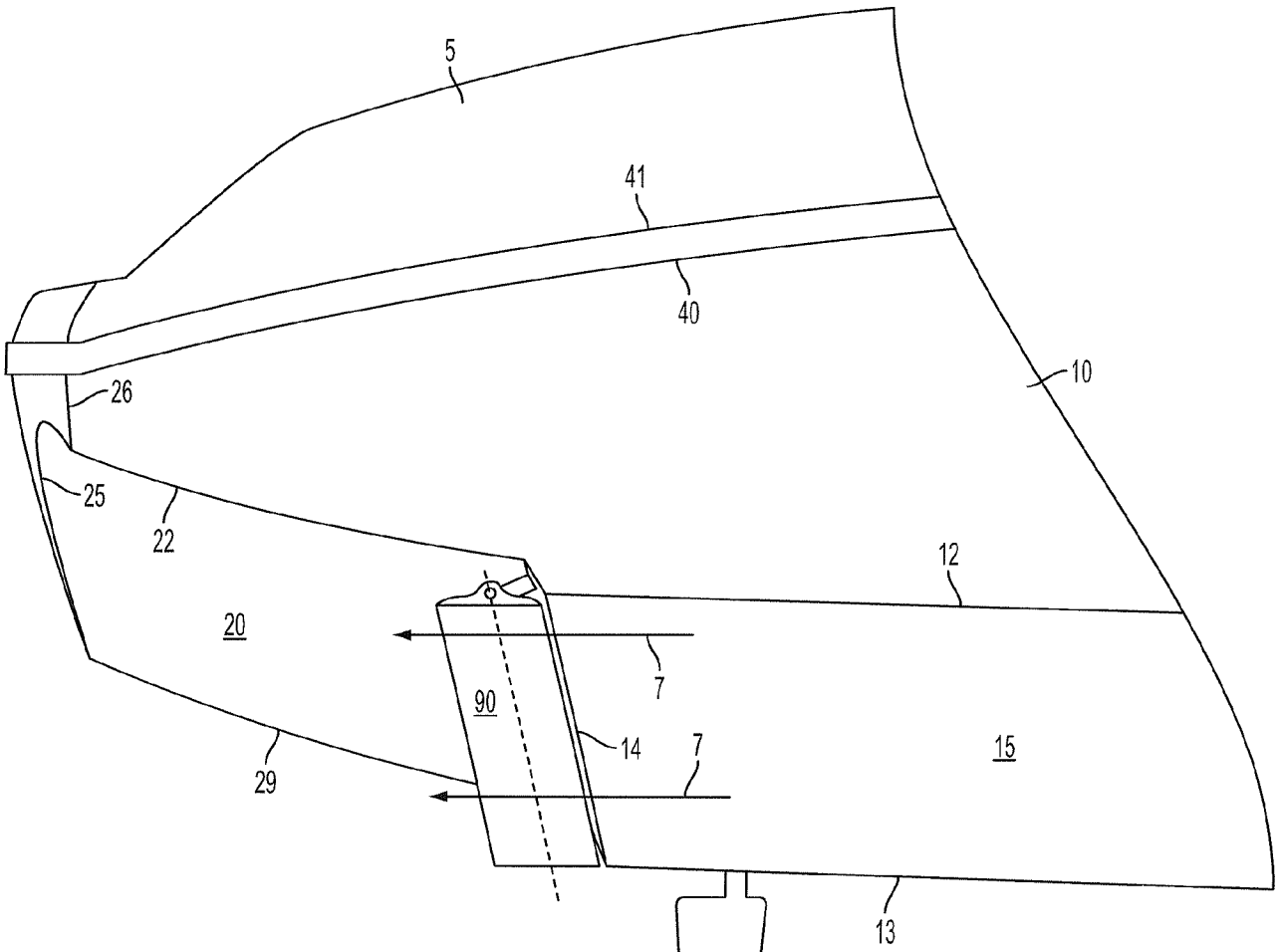
FIG. 5 is an enlarged partial stern elevation view of the tow boat of FIG. 1 shown with the pivotal tab in place, in its neutral position
Figure 6:
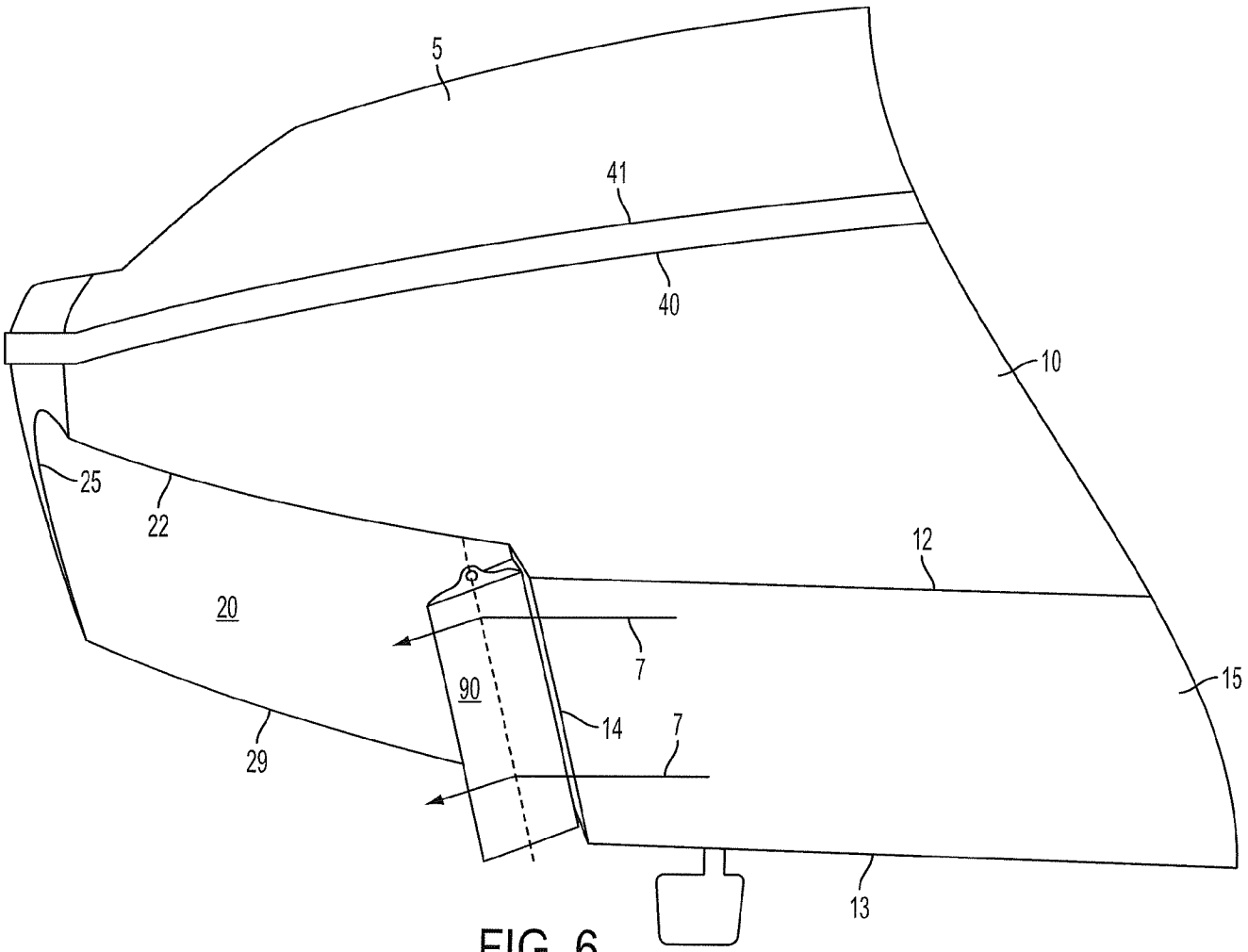
FIG. 6 is an enlarged partial stern elevation view of the tow boat of FIG. 1 shown with the pivotal tab in place, with its leading edge in the upper position
Figure 7:
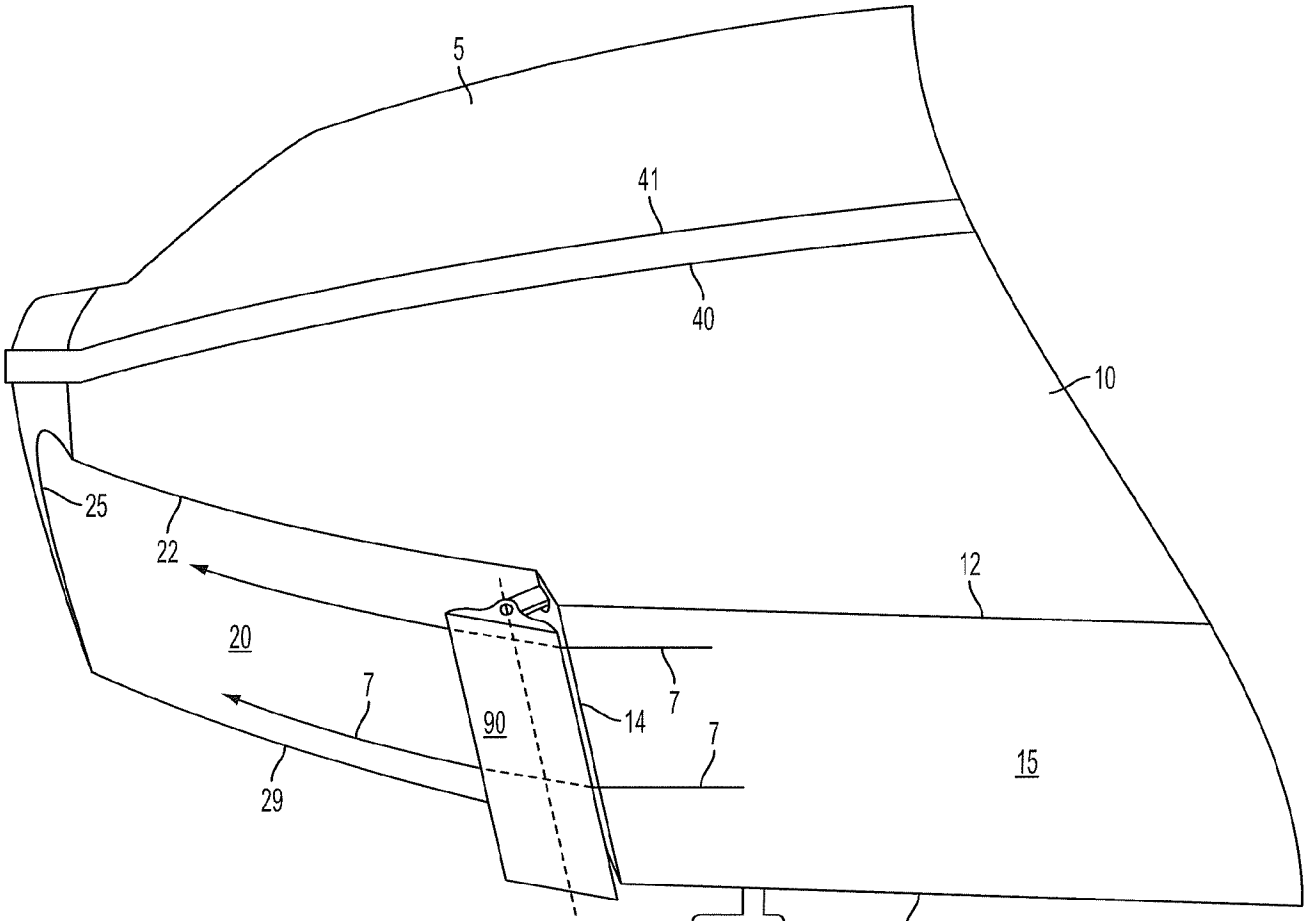
FIG. 7 is an enlarged partial stern elevation view of the tow boat of FIG. 1 shown with the pivotal tab in place, with its leading edge in the upper position
Figure 8:
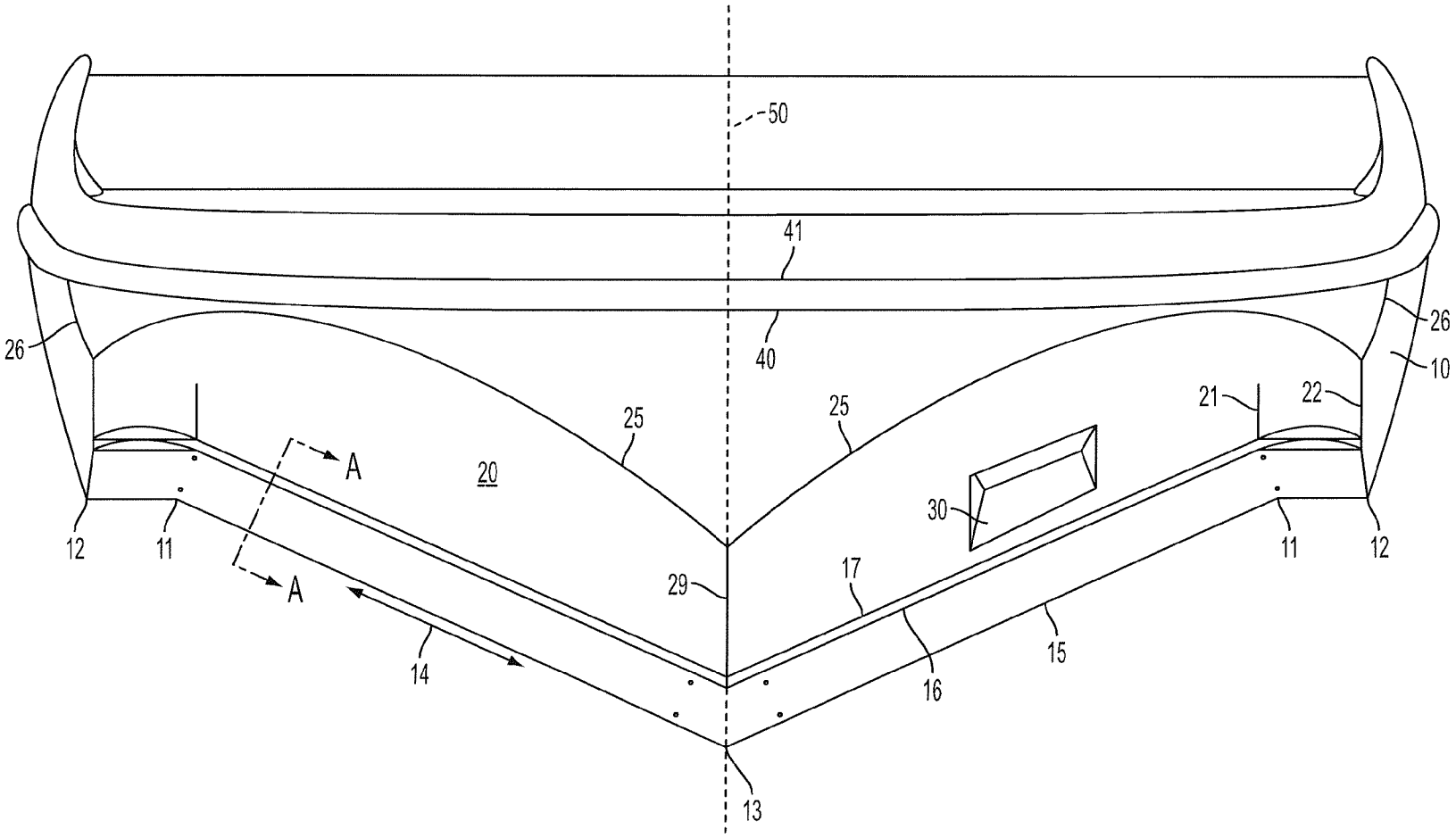
FIG. 8 is a stern elevation view of the tow boat of FIG. 1 shown with two distinct running surfaces shown without the pivotal tab in place.
Figure 9:
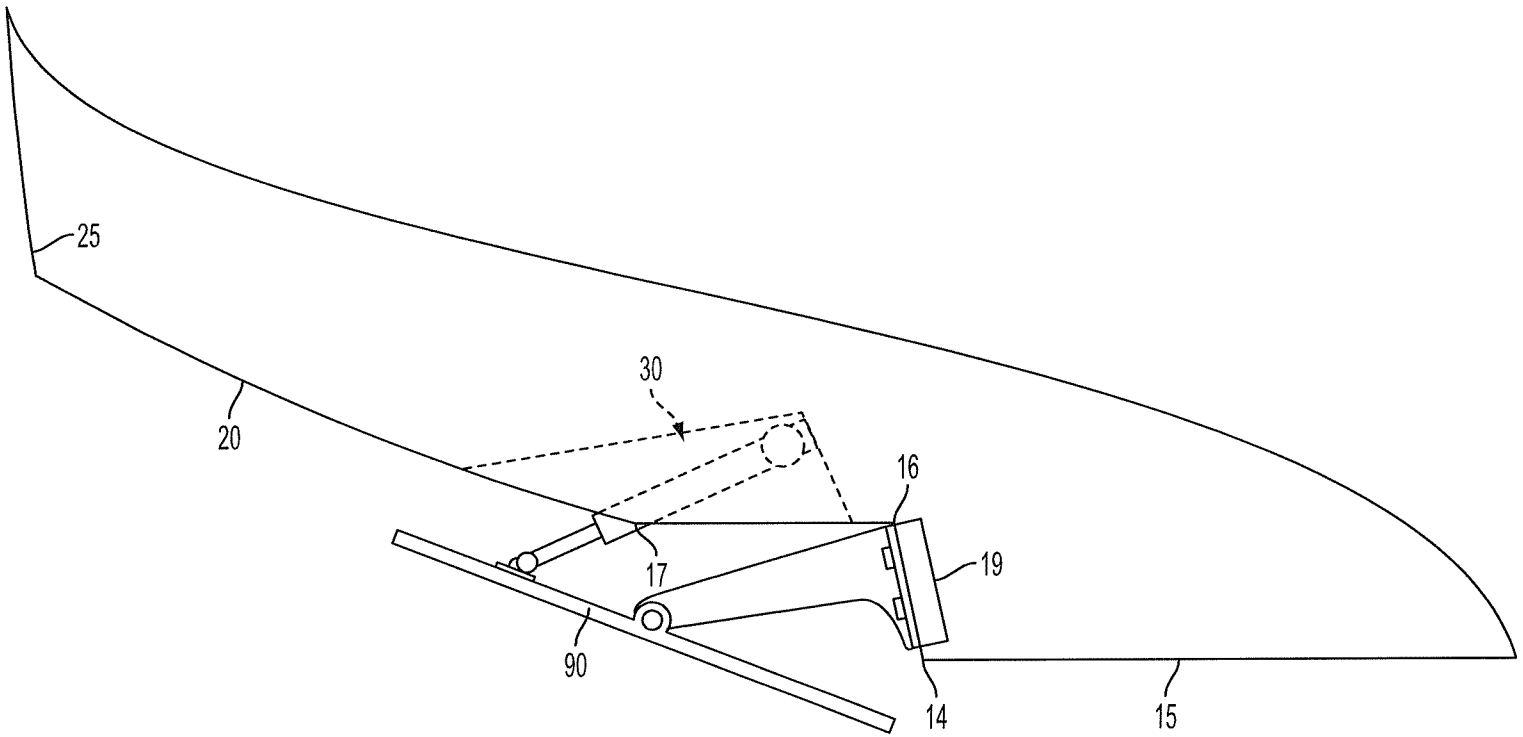
FIG. 9 is a partial cross-sectional along line A-A in FIG. 8.

Referring initially to FIGS. 1-8, embodiments of the present invention are directed to performance of a tow boat 10 and resulting creation of a wake 00 through a redirection of water flow 7 flowing from a primary hull 15 to a secondary suction hull 20 and the wake shaping effects of a specialized secondary transom 25. In keeping with the teachings of the present invention, the boat 10 is herein described as having the hull 15 with a keel 13 extending fore and aft, a chine extending fore and aft defined by a transition from the hull bottom panel 15 at 11, as seen in FIG. 4, and its outer chine edge 12, and a transom 14 which extends transversely across the hull bottom panels 15. As illustrated with reference to FIGS. 1-8, one embodiment of the present invention includes a secondary suction hull 20 extending aft of the primary hull 15. The secondary hull 20 is described as having a secondary keel 29 extending fore and aft, an inner diffuser edge 21 extending fore and aft, an outer diffuser edge 22 extending fore and aft at a height lower than the inner diffuser edge 21, and a secondary transom 25 which extends transversely from the hulls 10 centerline 50 to the intersection of the side of the hull at 26. FIG. 9, by way of example, shows a section view of FIG. 8, where the secondary hull 20 may be defined as having an entrance portion 16 positioned above transom 14 at a height 19 sufficient to break the water flow 7 and inhibit interaction with the secondary hull 20, and extend aft to an indentation 17 where water flow 7 will be reattached to hull surface 20 when redirected by pivotal tab 90.

As illustrated with reference to FIGS. 3, 8, 9, 10-11, a recessed pocket 30 may be included to allow clearance for the pivotal trim tab 90 mechanism.

As illustrated with reference to FIG. 7, the secondary hull 20 will achieve its desired effect of sucking the aft portion of the secondary hull 20 downward by redirecting water flow 7 off of the primary transom 14 onto the top of pivotal trim tab 90 whereby water flow 7 will reattach to secondary hull 20 where the surface is angled upward and with a rocker concave section as illustrated in FIG. 9

As illustrated with reference to FIGS. 8 and 11, the secondary hull surface 20 will hold its suction to the outer corners of the hull 10 by lowering the outer diffuser edge 22 past the upper edge of the secondary hull panel 20 at the inner diffuser edge 21, where outer diffuser edge 22 will function as a "seal" to the water flow 7 preventing air from entering a concavity 35 formed within the secondary running surface or hull 20 and breaking the suction. As illustrated with reference to FIGS. 1-11, the outer diffuser edge 22 transitions into the secondary transom 25 at the corner 26 of the hull 10 thereby sucking the secondary transom 25 into the water flow 7 where it can manipulate the water flow to create the desired wake shape.

As illustrated with reference to FIGS. 10 and 11, in one embodiment the secondary suction hull 20 includes a secondary keel 29 that curves upward so that the aft end of the keel 29 is above inner diffuser edge 21 when viewed in elevation to warp the secondary hull surface 20 into a concavity 35 defined by the inner and outer diffusion edges of the secondary transom 25. The lower corners 27 of the secondary transom 25 would create a forward face in the water flow 7 that would serve as an ideal surfing wake. It is expected that alternate transom shapes will become apparent to those skilled in the art now having the benefit of the teachings of the present invention. Such alternative, which perform the same function, in substantially the same way, with substantially the same result are considered to be within the scope of the subject invention.

Figure 12:
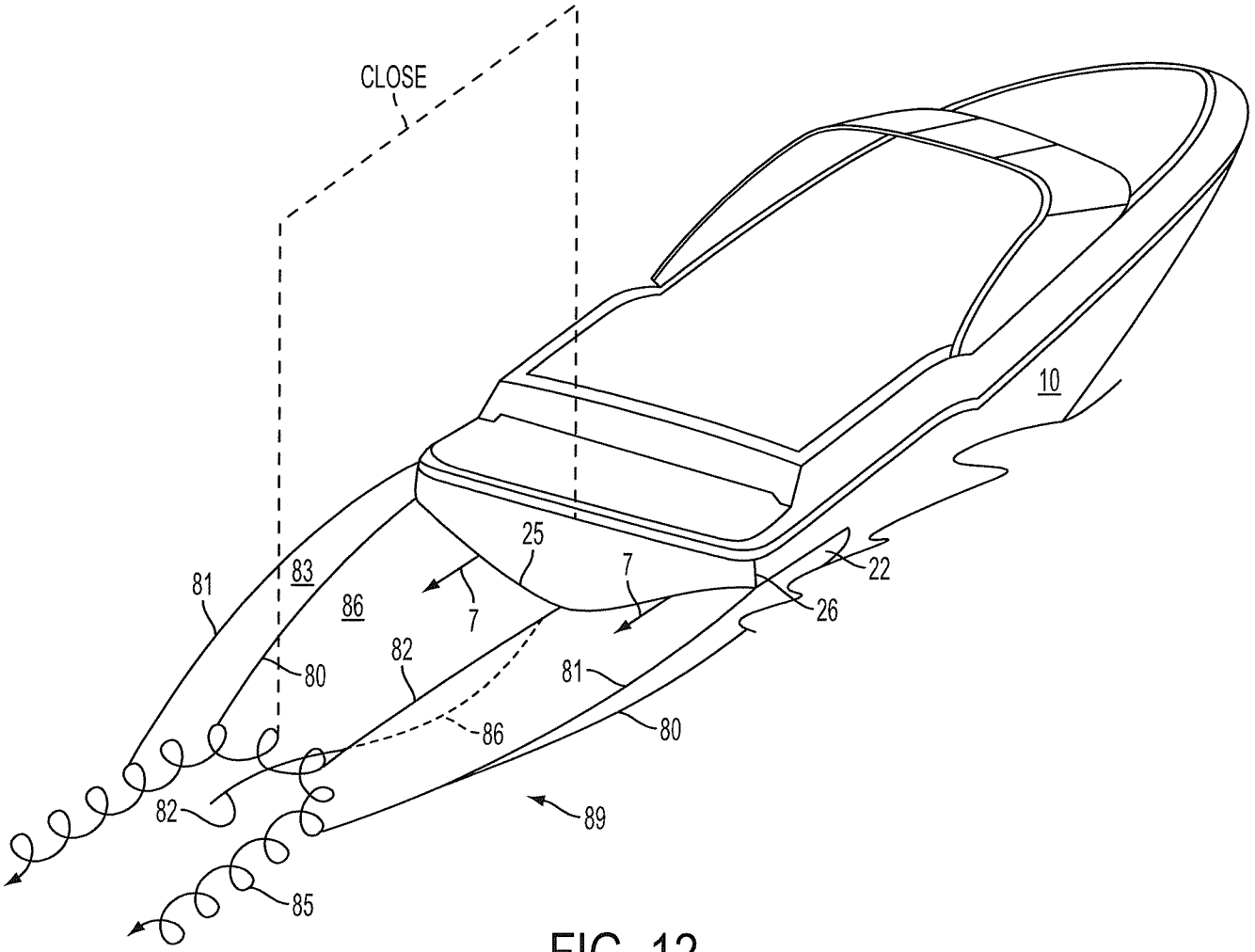
FIG. 12 is a perspective view of a boat creating a wake having specific cross-sectional shapes and curls behind the boat.

As illustrated with reference to FIG. 12, the wake shape with the water flow 7 redirected to act upon the secondary hull 20 will be determined by several factors including the secondary transom shape 25 seen in FIGS. 1-9, hull speed, and prop wash 82 which is caused by the accelerated water coming off of the propeller. The prop wash 82 usually exits a certain distance from the boat 10, and is often referred to as the rooster tail 82. The wake shape will have different sections and qualities at different distances from the boat 10. By way of example, the secondary transom 25 and the edge of the secondary hull 26 will create the initial shape of the wake as the boat travels over the water and the water flow converges together afterward. A vertical face 83 of water created by the side of the hull 26 can be defined by its upper edge 81 which is determined by the top level of the water that the boat is riding through and the lower corner 80, which is carved by the outer diffuser 22 as it sucks down and contacts the water. The water flow 7 coming off of the transom 25 will ultimately create the trough 86 that will converge back together some distance from the boat, depending on the hull speed. The prop wash 82 will emerge from under the water flow 7 and interact with the vertical face 83 creating a curl 85 that will be a desirable wake shape for a wake surfer. Additionally, the trough 86 specifically shaped by the secondary transom 25 will present an ideal trough 86 with two opposing faces 83 in which to surf in between at a higher speed more commonly found in naturally breaking waves.

Figure 10:
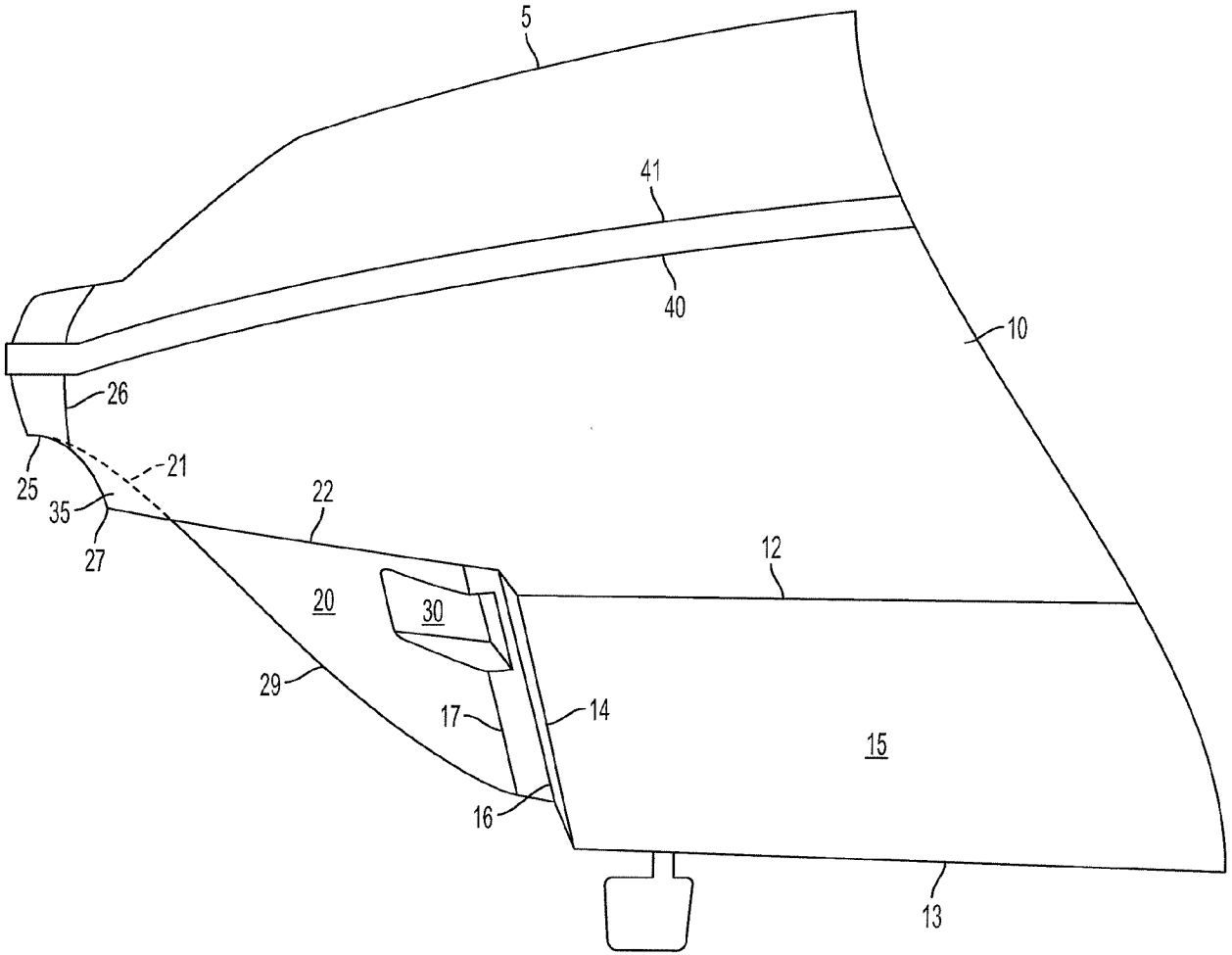
FIG. 10 is an enlarged partial stern elevation view of a hull with two distinct transom shapes and pocket for the actuator of the pivotal tab assembly, with an alternate transom shape in keeping with the teachings of the present invention.
Figure 11:
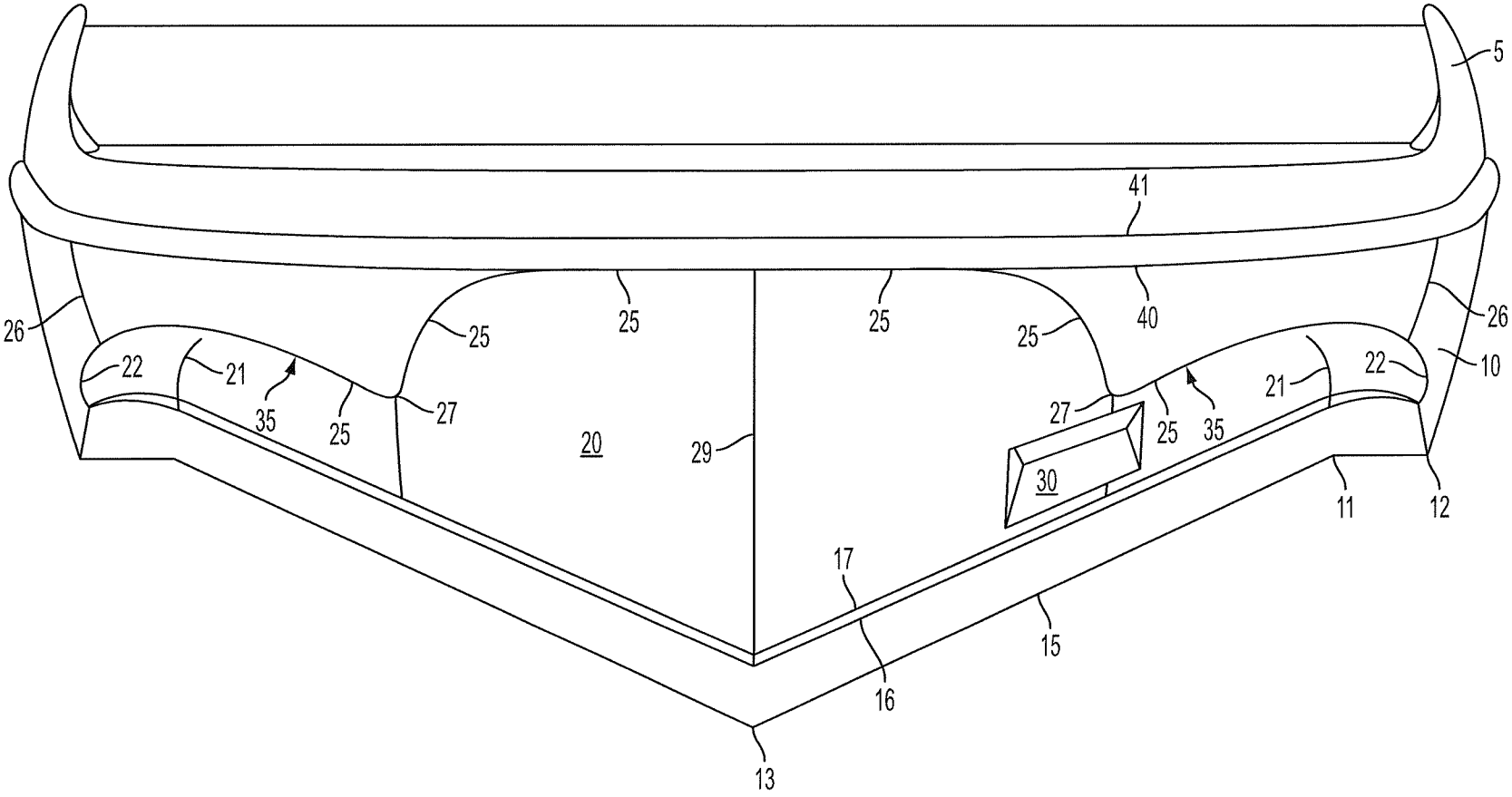
FIG. 11 is a stern elevation view of a hull with two distinct transom shapes and pocket for the actuator of the pivotal tab assembly, with an alternate transom shape in keeping with the teachings of the present.
Figure 13:
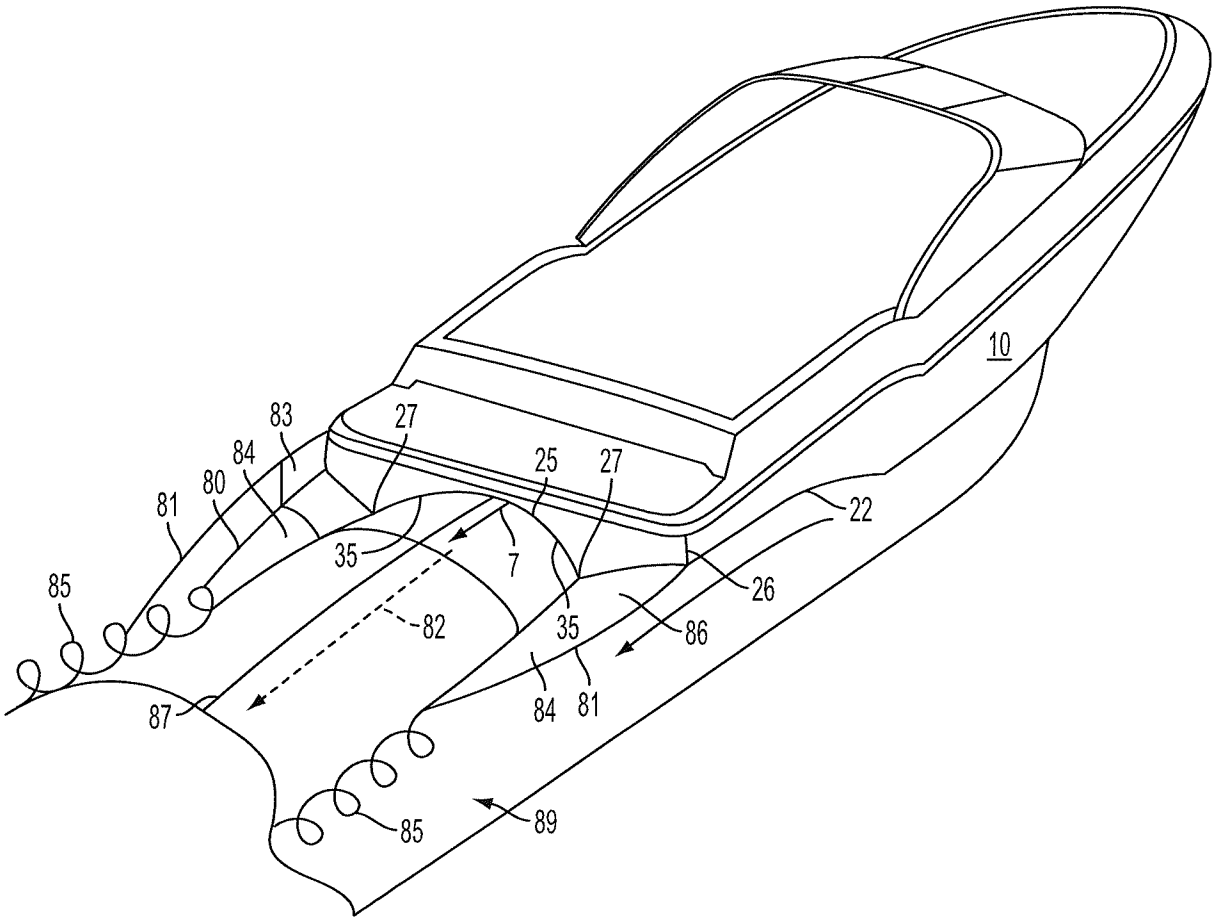
FIG. 13 is a perspective view of a boat creating a wake having specific cross-sectional shapes and curls behind the boat.

As illustrated with reference to FIG. 13, the wake shape with the water flow 7 redirected to act upon the secondary hull 20 will also be determined by several factors including a modified secondary transom shape 25 as seen in FIGS. 10 and 11, hull speed, and prop wash 82. The prop wash usually exits a certain distance from the boat 10, however, the suction force created by the secondary hull 20 and its specialized secondary transom 25 will lift the water flow 7 up to blend in with the rooster tail 82 creating a large swell 87. The swell will have different sections and qualities at different distances from the boat 10. By way of example, water exiting the transom 25 through the concavity 35 will be manipulated by the vertical edge 27 and will form a secondary vertical face 84 on either side of the swell 87, as shown in FIG. 13. A vertical face 83 of water created by the side of the hull 26 can be defined by its upper edge 81, which is determined by the top level of the water that the boat is riding through and the lower corner 80, which is carved by the outer diffuser 22 as it sucks down and contacts the water. When the vertical face 83 converges back into the larger secondary vertical face 84, it causes the lower edge of secondary vertical face 84 to trip and create the most ideal curl face 85 with an outer trough 89 in which two wake surfers can utilize. The ability to have two wake surfers able to surf next to each other is a feature not found anywhere in the industry or nature.

Figure 14:
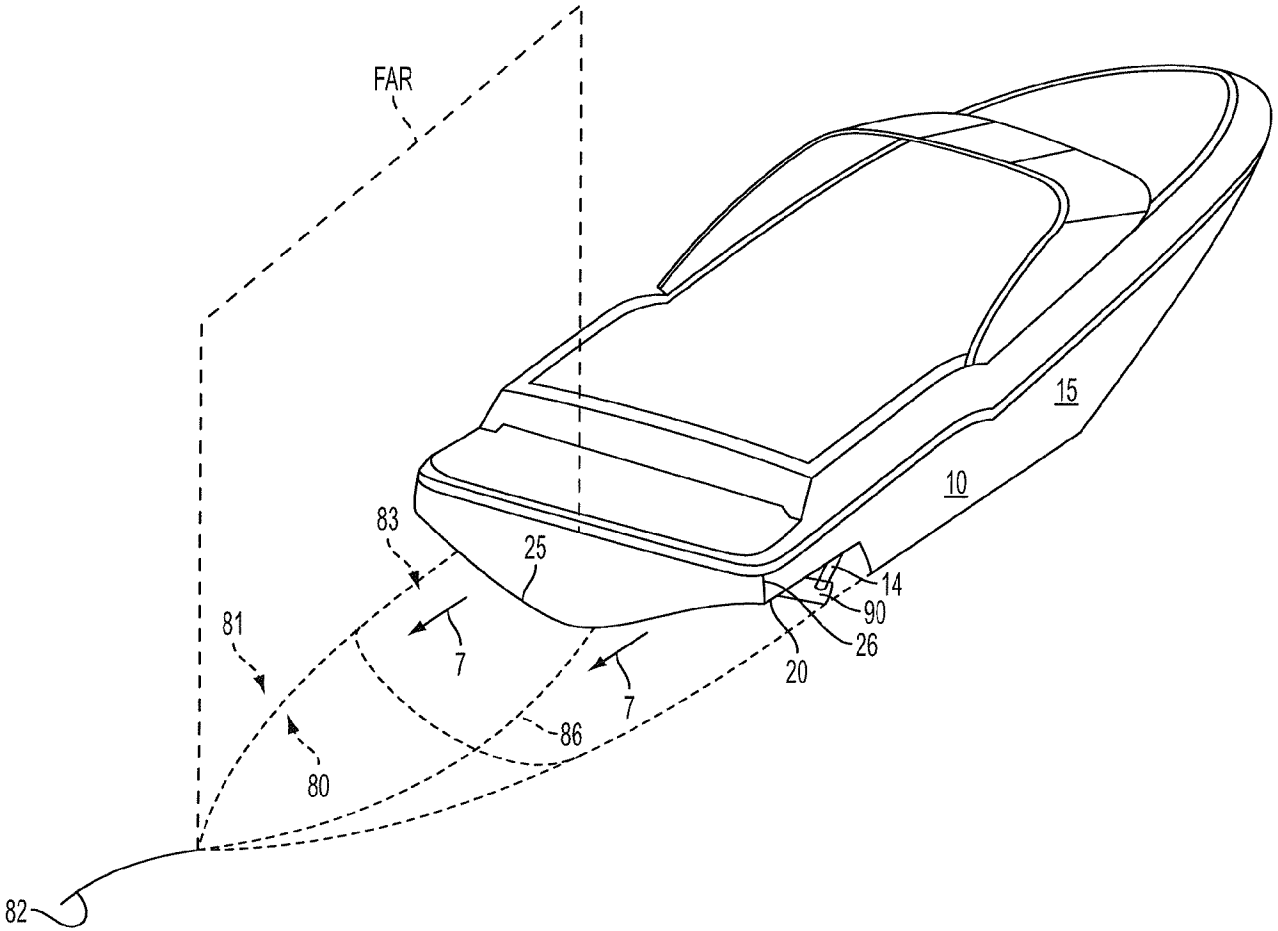
FIG. 14 is a perspective view of a boat creating a wake having specific cross-sectional shapes and curls behind the boat.

As illustrated with reference to FIG. 14, the wake shape with the water flow 7 not directed to act upon the secondary hull 20 will be that of an ordinary tow boat with a standard hull 15 and primary transom shape 14. With the pivotal trim tab 90 in the neutral position or in a position with its leading edge above the primary transom 14 the water flow will bypass the secondary suction hull 20 allowing greater speed and a flatter trough 86 that is preferred by water skiers. Additionally, greater speeds attained with the primary hull 15 will position the rooster tail 82 farther back which is ideal for the rope length utilized for wakeboarding.

As will become apparent to those skilled in the art now having the benefit of the teachings of the present invention, various combinations of the secondary suction hull 20 and the secondary wake shaping transom 25 can be employed depending on the wake to be achieved. By way of example, the secondary transom 25 may embody different sections to create specific wake shapes not mentioned in these teachings.

Many modifications and other embodiments of the invention will become apparent to one skilled in the art after having the benefit of the teachings presented in the included descriptions and drawings. Therefore, it is understood that the invention is not to be limited to the specific embodiments within the scope of the invention.

I claim:

1. A boat hull that creates a wake shape conducive to wake surfing, the hull comprising:

a primary hull having a fore end and an aft end and at least a portion therebetween that maintains contact with a water surface;

a transom located at the aft end of the primary hull, where the transom extends from the hull to a center line of the boat;

a secondary hull extending aft from the transom, the secondary hull comprising, an outer diffuser edge;

an inner diffuser edge located higher above the water surface than the outer diffuser edge;

a secondary keel that extends fore and aft on the secondary hull, such that the aft end terminates at a point further above the water surface than the inner diffuser edge; and a concavity formed within the secondary hull by the outer diffuser edge, the inner diffuser edge, and the secondary keel;

a secondary transom located at the aft end of the secondary hull;

a pivotal trim tab mechanism disposed between the primary hull and the secondary hull, where a trim tab of the pivotal trim tab mechanism extends generally perpendicular to the center line of the boat, such that water flowing past the primary hull can be redirected by the pivotal trim tab towards the secondary hull where the water flows through the concavity and past the secondary transom to cause a suction force that lowers the secondary hull into the water and creates the wake shape.

2. A boat hull according to claim 1, further comprising a pocket within the primary hull into which the pivotal trim tab mechanism can be at least partially recessed.

* * * * *